US011933057B2

(12) United States Patent
Jessop

(10) Patent No.: US 11,933,057 B2
(45) Date of Patent: Mar. 19, 2024

(54) SYSTEMS, METHODS, AND DEVICES FOR SECURING COMPONENTS TO CONCRETE WALLS

(71) Applicant: ICF Building Systems LLC, South Jordan, UT (US)

(72) Inventor: Alma Jessop, South Jordan, UT (US)

(73) Assignee: ICF Building Systems LLC, South Jordan, UT (US)

( * ) Notice: Subject to any disclaimer, the term of this patent is extended or adjusted under 35 U.S.C. 154(b) by 57 days.

(21) Appl. No.: 17/805,137

(22) Filed: Jun. 2, 2022

(65) Prior Publication Data

US 2023/0392396 A1 Dec. 7, 2023

(51) Int. Cl.
*E04G 17/07* (2006.01)
*E04G 11/08* (2006.01)

(52) U.S. Cl.
CPC ..... *E04G 17/0721* (2013.01); *E04G 11/08* (2013.01)

(58) Field of Classification Search
CPC ..... E04G 17/0721; E04G 17/06; E04G 17/07; E04G 17/075; E04G 17/0754; E04G 17/0758; E04G 2017/0646; E04G 17/0714; E04G 17/0652; E04G 11/10
See application file for complete search history.

(56) References Cited

U.S. PATENT DOCUMENTS 2,099,260 A * 11/1937 Colt ..... E04G 17/0652 249/43
2,709,292 A * 5/1955 Otti ..... E04G 17/0721 249/43
3,437,309 A * 4/1969 Dusan ..... E04G 17/0714 249/43
3,750,996 A * 8/1973 Maier ..... E04G 17/0714 249/43
3,841,600 A * 10/1974 Aubee, Jr. ..... E04G 17/0721 249/43
3,927,857 A * 12/1975 Lovisa ..... E04G 17/0735 249/43
3,933,332 A * 1/1976 Lovisa ..... E04G 17/0714 249/43
4,221,357 A * 9/1980 Bowden ..... E04G 17/0721 249/40

(Continued)

FOREIGN PATENT DOCUMENTS

DE 2021042 A1 * 11/1971
EP 1384838 A1 * 1/2004

(Continued)

*Primary Examiner* — Brian E Glessner
*Assistant Examiner* — Daniel J Kenny
(74) *Attorney, Agent, or Firm* — Workman Nydegger

(57) ABSTRACT

A tie system can include a concrete tie, a tie sleeve, and one or more tie sleeve connectors. The tie sleeve has a channel extending therethrough between first and second ends with openings at each end to provide access to the channel. The channel and openings are configured to have the concrete tie disposed partially within the channel with ends of the tie extending out of the openings. The tie sleeve connector has a generally T-shape formed by a first portion and a second portion. The first portion can be selectively inserted into and secured within the channel. The second portion extends from the first portion and is configured to be connected to another component such as an insulation panel.

19 Claims, 10 Drawing Sheets

(56) References Cited

U.S. PATENT DOCUMENTS

| | | | | |
|---|---|---|---|---|
| 4,726,560 | A * | 2/1988 | Dotson | E04G 17/0714 249/46 |
| 5,537,797 | A * | 7/1996 | Harkenrider | E04G 9/05 249/43 |
| 2003/0071189 | A1 * | 4/2003 | Petkau | E04G 17/0657 249/190 |
| 2004/0237438 | A1 | 12/2004 | Keith et al. | |
| 2007/0094974 | A1 | 5/2007 | Velickovic | |

FOREIGN PATENT DOCUMENTS

| | | | |
|---|---|---|---|
| FR | 2171751 | A5 * | 9/1973 |
| KR | 10-1999-0035156 | U | 9/1999 |
| KR | 100941150 | B1 * | 2/2010 |
| KR | 10-1066289 | B1 | 9/2011 |
| WO | WO-2004113645 | A1 * | 12/2004 |

* cited by examiner

SYSTEMS, METHODS, AND DEVICES FOR SECURING COMPONENTS TO CONCRETE WALLS

BACKGROUND

Technical Field

The present disclosure relates to systems, methods, and devices for securing components to concrete walls. More specifically, the present disclosure relates to systems, methods, and devices for securing concrete forms together and subsequently securing other components to concrete walls created with the concrete forms.

The Relevant Technology

Concrete is frequently used in the construction industry. For instance, concrete is commonly used in various aspects of building construction, including to form foundations, floors, and walls. In such applications, cast-in-place concrete is frequently used. Various types of forms can be used when casting concrete in place. For instance, when creating a building wall, form members may be erected so that an interior space within the form has the desired shape and size of the wall. Concrete can be poured into the form and held in place by the form while the concrete cures.

Due to the weight of the concrete, the form members are secured in place while the concrete is poured and cures. Bracing may be secured to the outside of the form members to help ensure that the form stays in place. Additionally, ties may be secured between opposing form members to secure the form members together and maintain a desired distance between the form members.

Once the concrete has sufficiently cured, the form may be removed or stripped from the concrete. This may include removing any bracing and the form members. The ties can either be removed from the concrete or the ends that extend out of the concrete can be broken or cut off.

While concrete, especially reinforced concrete, can be used to construct strong, stable buildings, there are some challenges encountered with concrete. For instance, concrete can have relatively low insulative properties (i.e., relatively low R-value), that make it difficult to efficiently control the climate within the building. Additionally, condensation can build up on the concrete due to temperature difference between the inside and the outside of the building. Further, the porous nature of concrete can allow water to migrate from the outside of the building to the interior of the building.

In an effort to address some of the challenges associated with the use of concrete in building construction, various systems have been developed. These systems include vapor barriers and insulation that can be applied or attached to the concrete walls in an effort to increase the R-value of the walls and reduce moisture transfer or buildup. However, the currently available systems are complex, expensive, and labor intensive to install.

Accordingly, there are a number of problems in the art that need to be addressed. The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

The present disclosure relates to systems, methods, and devices for securing components to concrete walls. More specifically, the present disclosure relates to systems, methods, and devices for securing concrete forms together and subsequently securing other components to concrete walls created with the forms.

In one example embodiment of the present disclosure, a tie system includes a tie sleeve and a tie sleeve connector. The tie sleeve has a channel extending at least partially therethrough and an opening in a first end thereof to provide access to the channel through the opening. The channel is configured to have a concrete tie selectively disposed at least partially within the channel and extending out of the tie sleeve through the opening. The tie sleeve connector is configured to be selectively connected to the tie sleeve. The tie sleeve connector has a first portion and a second portion. The first portion is configured to be selectively inserted into the channel through the opening and secured within the channel. The second portion extends from the first portion at an angle and is configured to engage a separate component.

In another example embodiment of the present disclosure, a tie system includes a concrete tie, a tie sleeve, and a tie sleeve connector. The concrete tie has a first end and an opposing second end, with a first engagement feature adjacent to the first end and a second engagement feature adjacent to the second end. The concrete tie is configured to be connected to a concrete form via the first and second engagement features. The tie sleeve has a channel extending therethrough between opposing first and second ends thereof. The tie sleeve has a first opening in the first end thereof and a second opening in a second end thereof to provide access to the channel through the first and second openings. The channel and first and second openings are sized and configured to have the concrete tie disposed partially within the channel with the first and second ends of the concrete tie extending out of the first and second openings in the tie sleeve. The tie sleeve is configured to allow for the concrete tie to be selectively removed from the tie sleeve through the first or second opening. The tie sleeve connector has a generally T-shape formed by a first portion and a second portion. The first portion is configured to be selectively inserted into the channel through the first or second opening and secured within the channel. The second portion extends from the first portion in opposing directions.

In a further example embodiment of the present disclosure, a tie system includes a tie sleeve. The tie sleeve includes a first end having an opening therein, an opposing second end having an opening therein, and a channel extending through the tie sleeve between the openings in the first and second ends. The channel is configured to have a concrete tie selectively inserted or removed therefrom through at least one of the openings at the first or second end. The tie sleeve also includes one or more retention features formed on an interior surface of the channel and one or more recesses formed on an exterior surface. The one or more recesses are configured to receive rebar therein.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Additional features and advantages of the disclosed embodiments will be set forth in the description which follows, and in part will be obvious from the description, or may be learned by the practice of the disclosure. These and other features will become more fully apparent from the following description and appended claims or may be learned by the practice of the present disclosure.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The present disclosure relates to systems, methods, and device for securing components to concrete walls. More specifically, the present disclosure relates to systems, methods, and devices for securing concrete forms together and subsequently securing other components to concrete walls created using the concrete forms.

Figure 1:
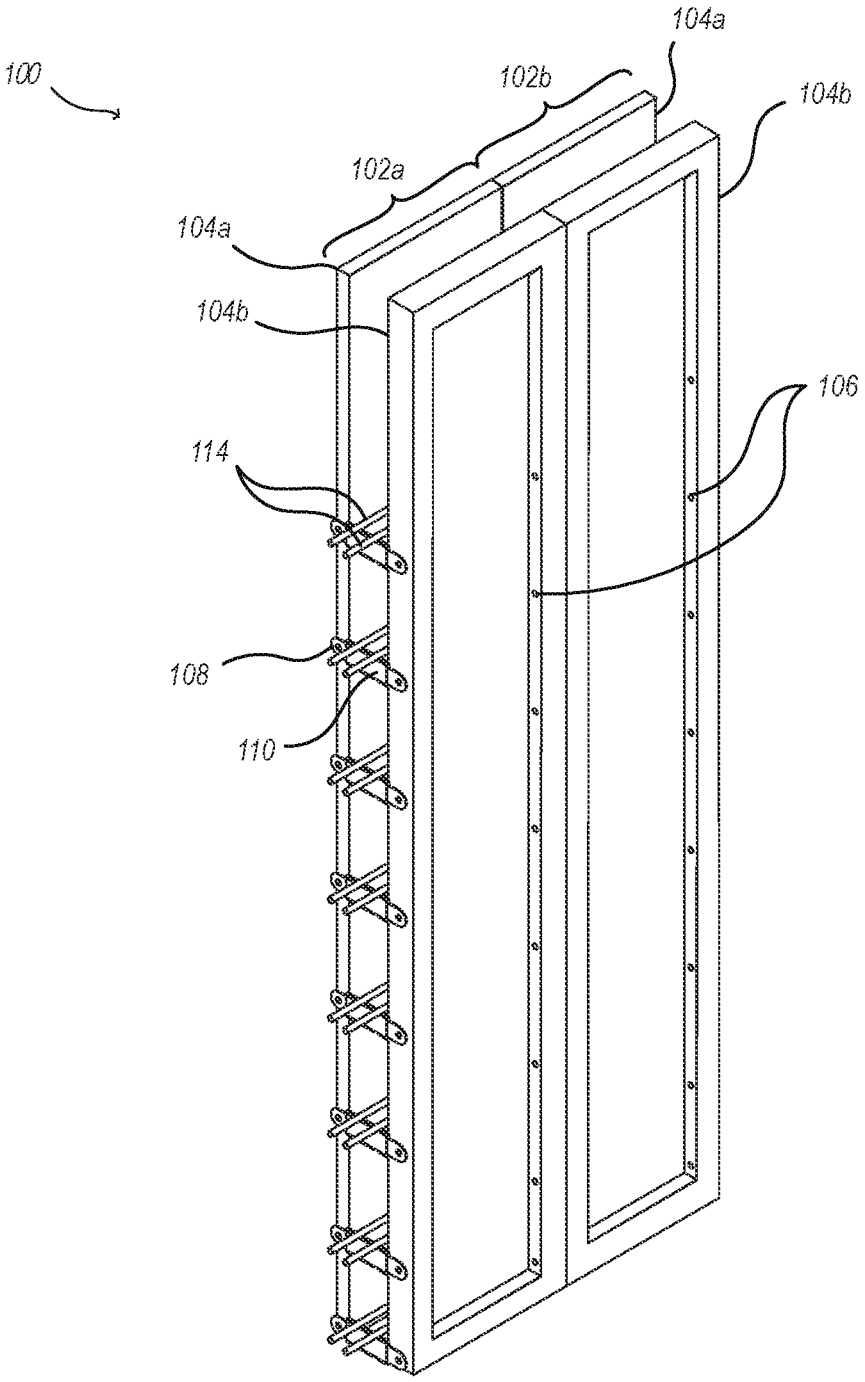
FIG. 1 illustrates an embodiment of a concrete form system.

FIG. 1 illustrates a portion of a concrete form system 100 that can be used to form, for example, concrete foundations or walls of a building. In the illustrated embodiment, the form system 100 includes form segments 102*a*, 102*b* (each form segment may be referred to herein generally as a form segment 102). It will be appreciated that a form system as contemplated herein may include a single form segment or more than two form segments. It will also be appreciated that the dimensions and shapes of the form segments may vary from one embodiment to another. For instance, the form segments 102*a*, 102*b* are configured for forming straight wall segments. However, other form segments may be configured for forming inside corner wall segments, outside corner wall segments, curved wall segments, and the like.

Each form segment 102 includes opposing form members 104*a*, 104*b*. In the illustrated embodiment, the form members 104*a*, 104*b* can be generally configured as large panel structures. The inner surfaces of the form members 104*a*, 104*b* (i.e., the surfaces that face one another) form the contours of the form and, thus, the size, shape, and contours of the concrete foundation or wall that will be formed therewith.

Adjacent form members 104*a*, 104*a* and 104*b*, 104*b* can be secured together end-to-end or along their adjacent vertical sides. The adjacent form members can be secured together via one or more fasteners 106. The fasteners 106 may include nuts, bolts, clamps, clips, mating locking features, and the like. In some embodiments, such as that illustrated in FIG. 1, the form members 104*a*, 104*b* may include flanges extending from outer surfaces thereof (e.g., the surfaces of form members 104*a*, 104*b* that face away from one another) to facilitate the connection therebetween. For instance, the flanges may have one or more apertures (threaded or straight) that are configured to have the fasteners 106 inserted therethrough or secured therein.

The opposing form members 104*a*, 104*b* may also be secured together to prevent the form members 104*a*, 104*b* from spreading apart when the form system 100 is filled with concrete. In the illustrated embodiment, the opposing form members 104*a*, 104*b* are secured together with a plurality of ties 108. The ties 108 can be secured to the form members 104*a*, 104*b* using the same fasteners 106 that are used to secure the adjacent form members together or with other fasteners.

As illustrated in FIG. 1, a tie sleeve 110 is disposed around a portion of the length of each tie 108. The tie sleeves 110 will be discussed in greater detail below. Briefly, however, each tie sleeve 110 extends between (and optionally beyond) the inside surfaces of opposing form members 104*a*, 104*b*. As a result, when the form system 100 is filled with concrete, the concrete encases or surrounds the tie sleeves 110, but does not contact the ties 108.

One or more outer surfaces of the tie sleeves 110 may include one or more recesses 112 or other retention features. The recesses or other retention features may facilitate proper placement of other components relative to the tie sleeves 110. For instance, as shown in FIG. 1, the recesses may facilitate and maintain the proper placement of rebar 114 within the form system 100 while concrete is poured therein so that the rebar 114 can reinforce and strengthen the concrete.

Figure 2:
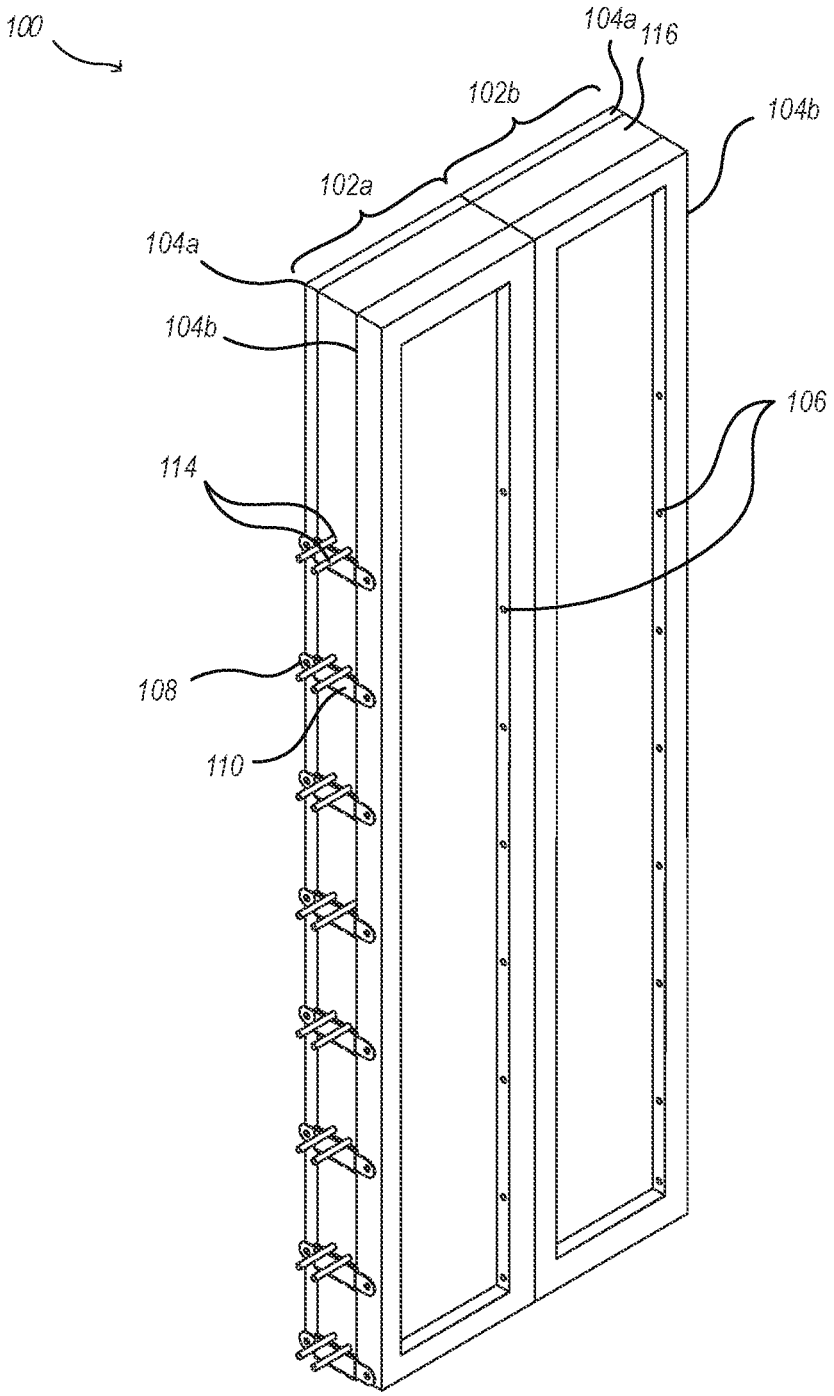
FIG. 2 illustrates the concrete form system of FIG. 1 filled with concrete.

Once the concrete form system 100 is fully assembled, concrete 116 can be poured or otherwise disposed therein (i.e., between opposing form members 104*a*, 104*b*) as shown in FIG. 2. As alluded to above, securing adjacent form members 104*a*, 104*a* and 104*b*, 104*b* together with fasteners 106 and securing opposing form members 104*a*, 104*b* together with ties 108 can maintain the shape of the form system 100 and, thus, the concrete 116 as the concrete 116 cures.

Figure 3:
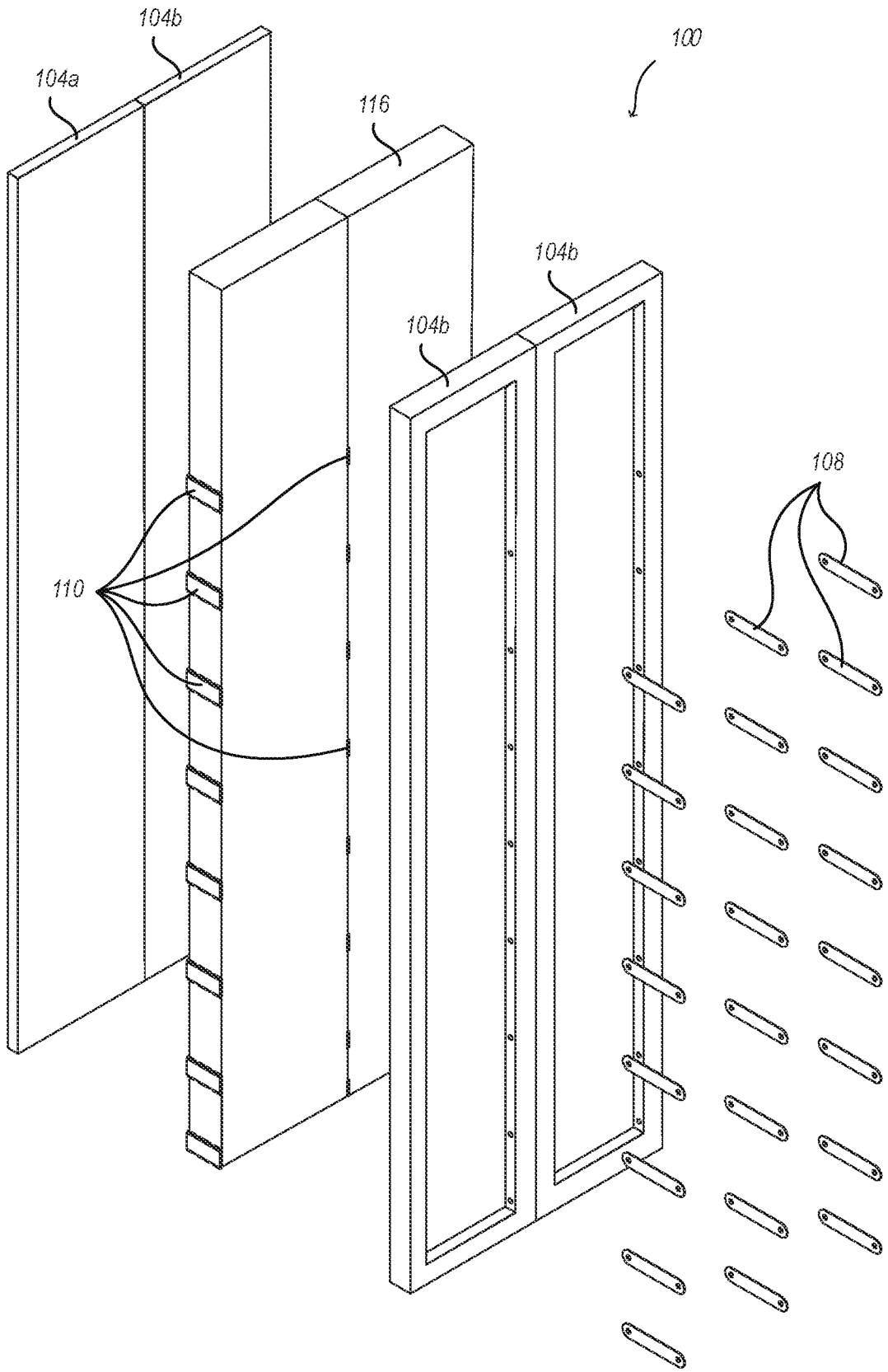
FIG. 3 illustrates an exploded view of the concrete form system of FIG. 2 showing a concrete wall formed therewith.

Once the concrete has sufficiently cured, the form system 100 may be removed to expose the concrete 116 (also now referred to as concrete wall 116), as shown in FIG. 3. To remove the form system 100, adjacent form members 104*a*, 104*a* and 104*b*, 104*b* may be disconnected from one another by disconnecting or removing the fasteners 106. Similarly, the form members 104*a*, 104*b* can be disconnected from the ties 108 by disconnecting or removing the fasteners connected therebetween. In addition to removing the form members 104*a*, 104*b*, the ties 108 can be removed from the tie sleeves 110. As discussed in greater detail below, each tie sleeve 110 has a channel extending therethrough and openings at opposite ends of the tie sleeve 110, providing access to the channel. The ties 108 can be slid out of the channel through one of the openings, thereby removing the tie 108 from the tie sleeve 110. If desired, the form members 104 and ties 108 can be reused later on.

As can be seen in FIG. 3, the tie sleeves 110 remain within concrete wall 116. The tie sleeves 110 extend between opposing sides of the concrete wall 116 with the opening in the ends thereof being exposed. Leaving the tie sleeves 110 in the concrete wall 116 can facilitate the connection of other components to the concrete wall 116, as discussed below.

Figure 4:
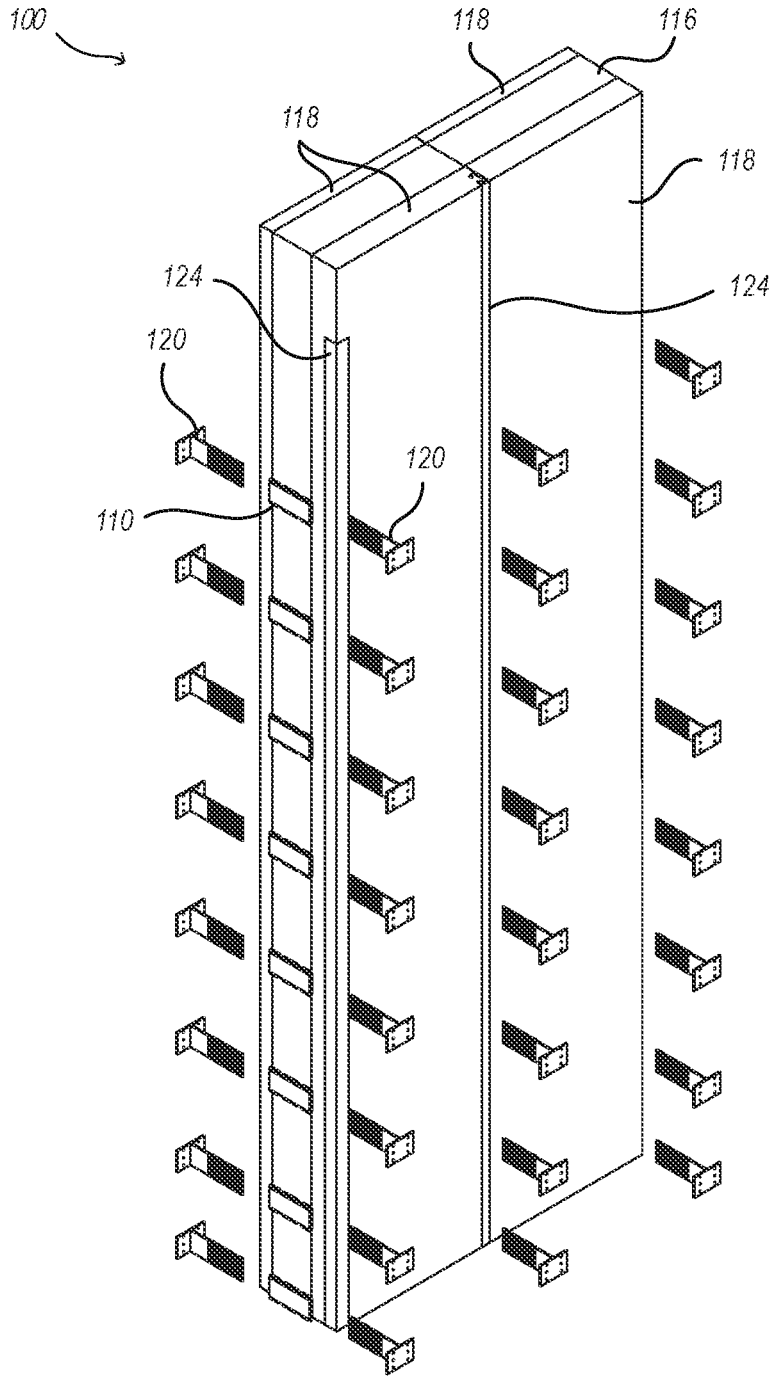
FIG. 4 illustrates a perspective view of a concrete wall with insulation panels positioned thereagainst.

For instance, FIG. 4 illustrates the concrete wall 116 with insulation panels 118 positioned thereagainst. The insulation panels 118 may be configured to enhance various properties of concrete wall 116. For instance, the insulation panels 118 may provide greater insulation (R-value via higher thermal mass), sound ratings (e.g., sound transmission class ("STC") ratings of 50-60), reduced condensation, and the like to the wall.

Figure 5:
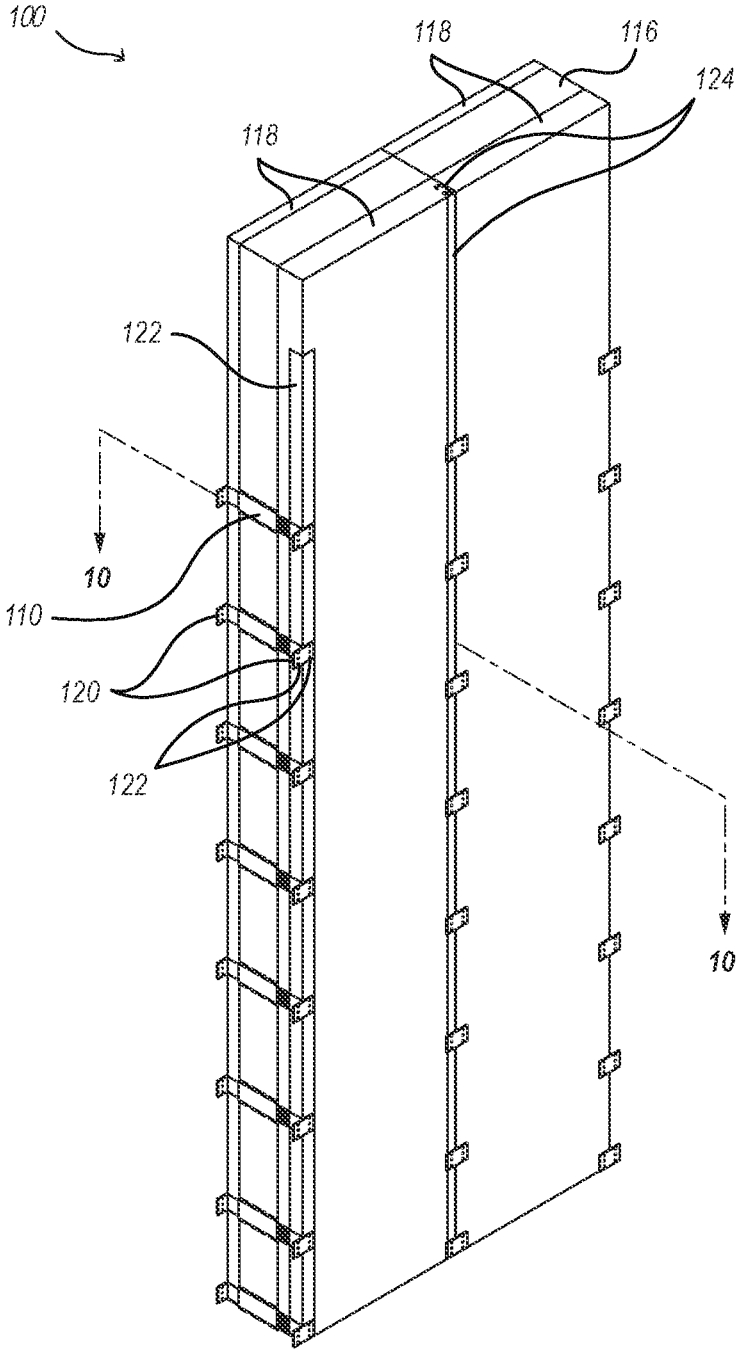
FIG. 5 illustrates the concrete wall of FIG. 4 with the insulation panels thereof attached to the concrete wall.

The insulation panels 118 may be secured to the concrete wall 116 via the tie sleeves 110 that remain disposed within the concrete wall 116. More specifically, the tie sleeve connectors 120 may be selectively connected to the tie sleeves 110 in a manner that holds the insulation panels 118 against the concrete wall 116. As will be discussed in greater detail below, each tie sleeve connector 120 may include a first portion and a second portion. The first portion may be insertable partially within the channel in a tie sleeve 110 and the second portion may be configured to engage the one or more insulation panels 118 and/or one or more associated structural components (e.g., 2×2 or 2×4 wood piece(s), metal U- or C-channel studs(s), I-beams, etc.) to hold the insulation panels 118 against the concrete wall 116, as shown in FIG. 5. With the insulation panels 118 held against the concrete wall 116, the tie sleeve connectors 120 can optionally be secured to the insulation panels 118 and/or one or more associated structural components with one or more fasteners 122 (e.g., screws, nails, clips, etc.).

In some embodiments, the insulation panels 118 can be positioned against the concrete wall 116 and the one or more structural components may be positioned on a side of the insulation panels 118 opposite to the concrete wall 116. The insulation panels 118 can thereby be sandwiched between the concrete wall 116 and the one or more structural components. One end of the tie sleeve connectors 120 can then be inserted and secured to the tie sleeves 110 and the other end can be secured to the structural components via the fasteners 122, thereby securing or holding the insulation panels 118 against the concrete wall 116.

In some embodiments, the insulation panels 118 may include the one or more structural components 124 incorporated therein or attached thereto. The structural components 124 may facilitate a strong and lasting connection between the tie sleeve connectors 120 and the insulation panels 118 via the fasteners 122. For instance, as shown in FIGS. 4 and 5, the insulation panels 118 may include a piece of wood or metal recessed into a corner thereof or otherwise attached to an edge/side thereof. Additionally, or alternatively, a U- or C-channel stud/beam may be connected to a vertical edge of the insulation panel 118. A portion of the U- or C-channel stud/beam may be inserted into a vertical edge of the panel 118 and a second portion may extend onto a face of the panel 118. Structural components 124 may be incorporated into or attached to one or both vertical edges/sides of the insulation panels 118.

In some embodiments, such as that illustrated in FIGS. 4 and 5, the structural components 124 are offset or disposed closer to one side of the insulation panel 118 than the other side of the insulation panel 118. The offset allows for insulation from the insulation panel 118 to be disposed between the structural component 124 and the concrete wall 116. Such an arrangement creates a thermal break between the concrete wall 116 and the structural component 124, thereby reducing the amount of thermal energy that can be transferred between the concrete wall 116 and the structural components 124, also known as or referred to as thermal mass.

While FIGS. 4 and 5 focus on using the tie sleeves 110 and tie sleeve connectors 120 to connect insulation panels 118 to the concrete wall 116, it will be appreciated that this is merely exemplary. In other embodiments, the tie sleeves 110 and tie sleeve connectors 120 may be used to connect various other components to the concrete wall 116 regardless of whether the other components are connected to or associated with the insulation panels 118. For instance, the tie sleeves 110 and tie sleeve connectors 120 may be used to connect structural components (e.g., 2×2 or 2×4 wood piece(s), metal U- or C-channel studs(s), I-beams, etc.) to the concrete wall. With the structural components connected to the concrete wall 116, other elements may be added. For instance, insulation (batt or roll insulation, spray foam, etc.) or other elements (plumbing pipes, electrical conduits, etc.) may be disposed within the cavities formed by the structural components. Drywall or other wall cladding material may then be connected to the structural components.

Attention is now directed to FIGS. 6-10, which illustrate an example embodiment of a tie system for use in connection with the form system 100. The tie system can include one or more ties 108, one or more tie sleeves 110, one or more tie sleeve connectors 120, or combinations thereof.

Figure 6:
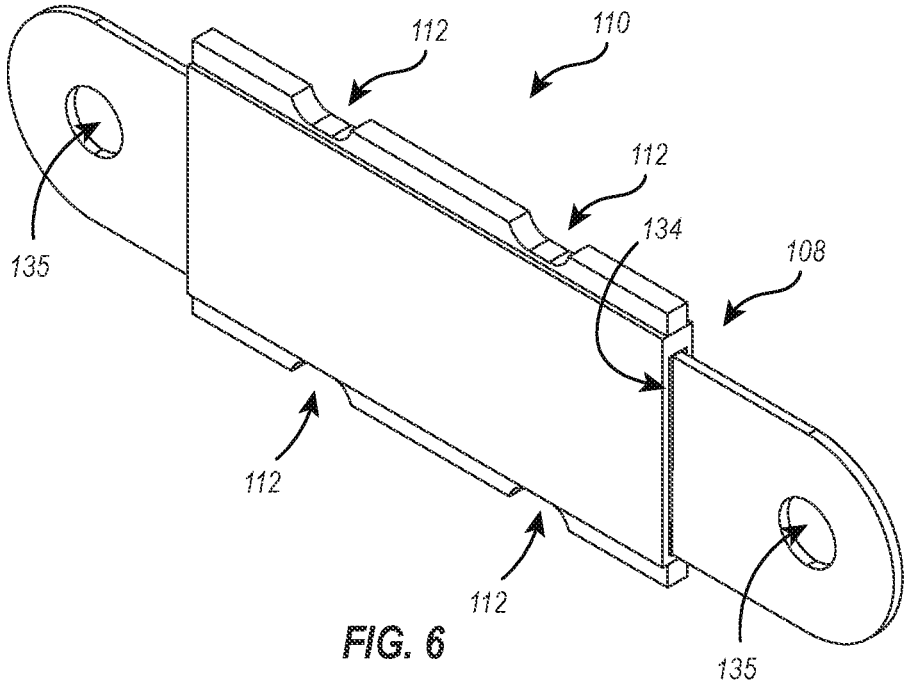
FIG. 6 illustrates a concrete tie disposed partially within a tie sleeve.

FIG. 6 illustrates a tie 108 disposed within a tie sleeve 110. The tie sleeve 110 has a channel 132 (see FIG. 10) extending therethrough. Each end of the tie sleeve 110 includes an opening 134 into the channel 132. The tie 108 can be inserted into one of the openings 134 and through the channel 132 so as to be disposed within the tie sleeve 110.

With the tie 108 disposed within the tie sleeve 110 as shown, the tie 108 can be connected to the opposing form members 104*a*, 104*b* as mentioned above. More specifically, one or more fasteners (e.g., fasteners 106) may be connected between the form members 104*a*, 104*b* and one or more engagement feature 135 at opposing ends of the tie 108. In the illustrated embodiment, the one or more engagement features 135 include an aperture at each end of the tie 108. The one or more fasteners may extend through apertures and be secured to the form members 104*a*, 104*b*.

As can be seen, the tie 108 has a length that is longer than a length of the tie sleeve 110. As a result, opposing ends of the tie 108 extend out of opposing first and second ends of the tie sleeve 110 and can be connected to the form members 104*a*, 104*b*. Additionally, the length of the tie sleeve 110 can be at least long enough to span the distance between the form members 104*a*, 104*b* as described above.

As noted above, the outer surface of the tie sleeve 110 may include one or more recesses 112. The one or more recesses 112 may facilitate the proper placement of rebar on tie sleeve 110. The one or more recesses 112 may maintain the positioning of the rebar while concrete is poured into the form system 100 and while the concrete cures.

In the illustrated embodiment, the tie sleeve 110 includes two recesses 112 on an upper surface thereof and two recesses 112 on a lower surface thereof. The number of recesses may vary from one embodiment to another. Additionally, while including recesses 112 on both upper and lower surfaces allows the tie sleeve 110 to be used in an inverted orientation, such is merely exemplary, and one or more recesses may be included on one or more surfaces.

Figure 7:
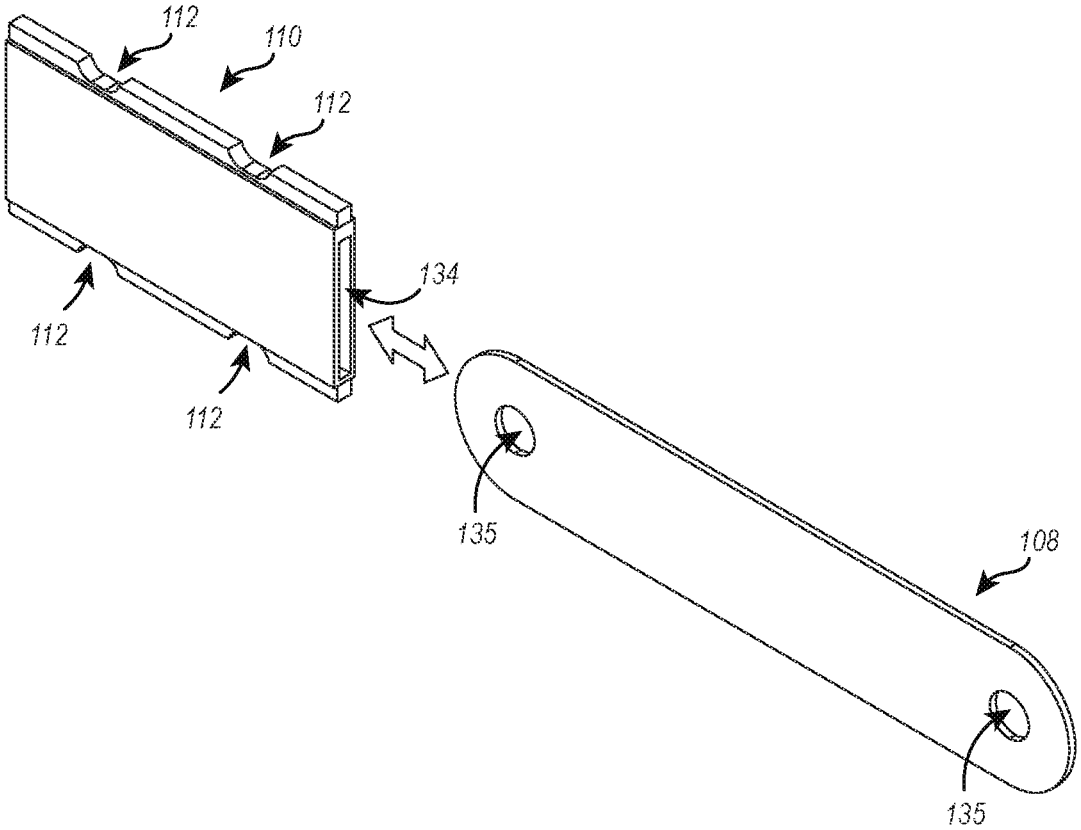
FIG. 7 illustrates the concrete tie and tie sleeve of FIG. 6, with the concrete tie removed from the tie sleeve.

Once the concrete wall 116 has sufficiently cured and the form members 104 have been removed, the tie 108 can be removed from the tie sleeve 110 as shown in FIG. 7. In particular, the tie 108 can be slid out of the channel 132 through one of the openings 134. As noted above, the tie sleeve 110 will remain in the concrete wall 116, while the tie 108 can be reused or discarded. With the tie sleeve 110 secured within the wall 116 (via the cured concrete disposed around the tie sleeve 110) and the tie 108 removed therefrom, additional components (e.g., insulation panels 118, structural components 124, etc.) can be secured to the concrete wall 116 with tie sleeve connectors 120. As noted above, the tie sleeve connectors 120 may be secured directly to the insulation panels 118 and/or to the structural components. In some embodiments, securing the tie sleeve connectors 120 to the structural components can sandwich and securely hold the insulation panels 118 between the concrete wall 116 and the structural components. In other embodiments, the tie sleeve connectors 120 may be secured to the structural components and then insulation (batt or roll insulation, spray foam, etc.) may be disposed within the cavities formed by the structural components.

Figure 8:
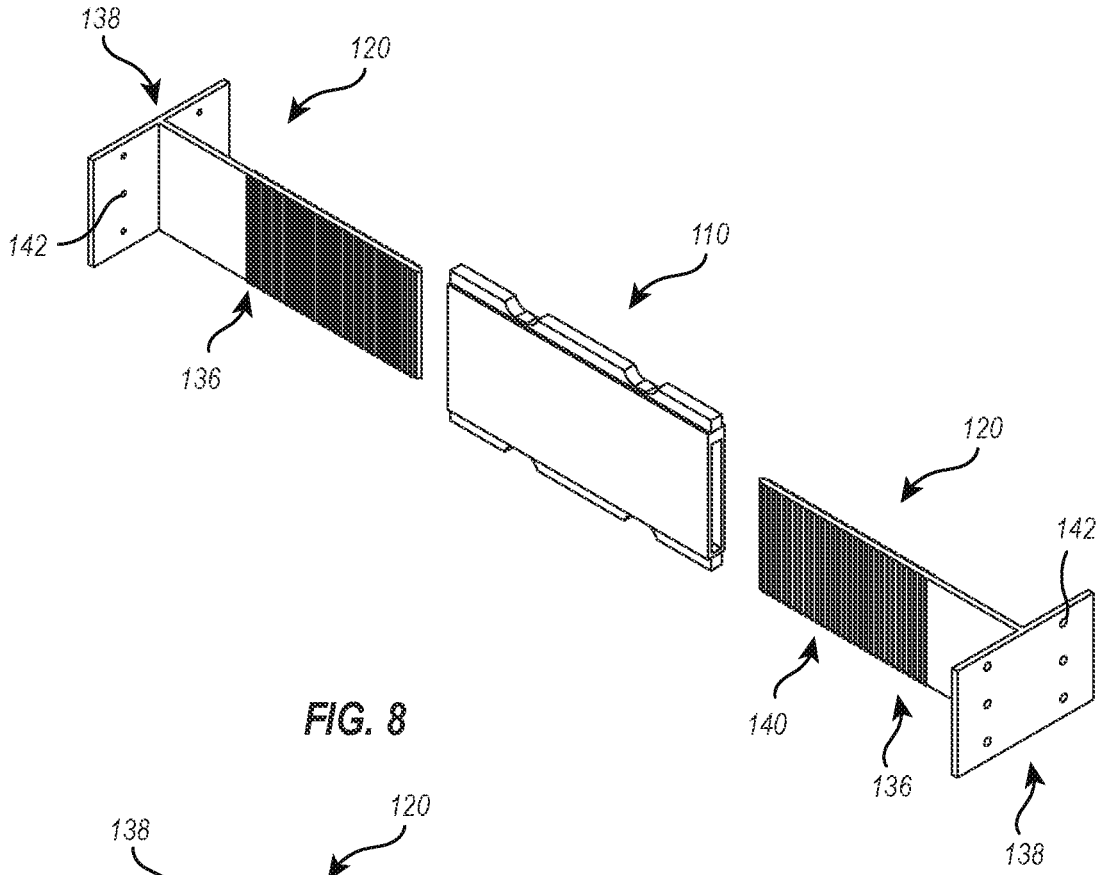
FIG. 8 illustrates the tie sleeve of FIGS. 6 and 7 with tie sleeve connectors.

FIG. 8 illustrates the tie sleeve 110 with two tie sleeve connectors 120 separate from the tie sleeve 110. In the illustrated embodiment, each tie sleeve connector 120 has a generally T-shaped configuration formed by a first portion 136 and a second portion 138. In the illustrated embodiment, each of the first and second portions 136, 138 has a generally rectangular cross-sectional shape. As can be seen, the cross-sectional shape of the first portion 136 is relatively narrow, especially when compared to a height and width thereof. The relatively narrow dimension of the first portion 136 allows the first portion to extend between adjacent insulation panels 118 (see FIG. 5) while still allowing adjacent insulation panels 118 to be positioned close to or on contact with one another.

It will be appreciated that one of both of the first and second portions 136, 138 may have other cross-sectional shapes (e.g., circular, oval, square, diamond, etc.). In some embodiments, the cross-sectional shape of the first portion 136 generally corresponds to a cross-sectional shape of the channel 132 and/or the openings 134 in the tie sleeve 110, such that the first portion 136 can be inserted at least partially therein.

The ties sleeve connectors 120 can be secured to the tie sleeve 110 to facilitate connection of the additional components to the concrete wall 116. For instance, as noted and shown in FIG. 9, the first portions 136 of the tie sleeve connectors 120 can be inserted at least partially into the channel 132 of the tie sleeve 110 through the openings 134 in the opposing ends of the tie sleeve 110. As will be discussed in greater detail below, the first portions 136 of the tie sleeve connectors 120 can include one or more engagement or retention features 140 that can be used to secure the tie sleeve connectors 120 to the tie sleeve 110. The retention features 140 can be disposed on one or more outer surfaces (or portions thereof) of the first portion 136, and may include projections, recesses, shoulders, high friction materials/coatings, and the like, or combinations thereof.

The second portion 138 of the tie sleeve connector 120 may extend from the first portion 136 in one or more directions and at one or more angles. In the illustrated embodiment, the second portion 138 extends from the first portion 136 in two opposing directions. The first and second portions 136, 138 form generally perpendicular or right angles in the illustrated embodiment. It will be appreciated, however, that the second portion 138 may extend from the first portion in only one direction (e.g., such that the first and second portions form a generally L-shape). Similar, the second portion 138 may extend from the first portion 136 at one or more angles other than 90°.

Figure 9:
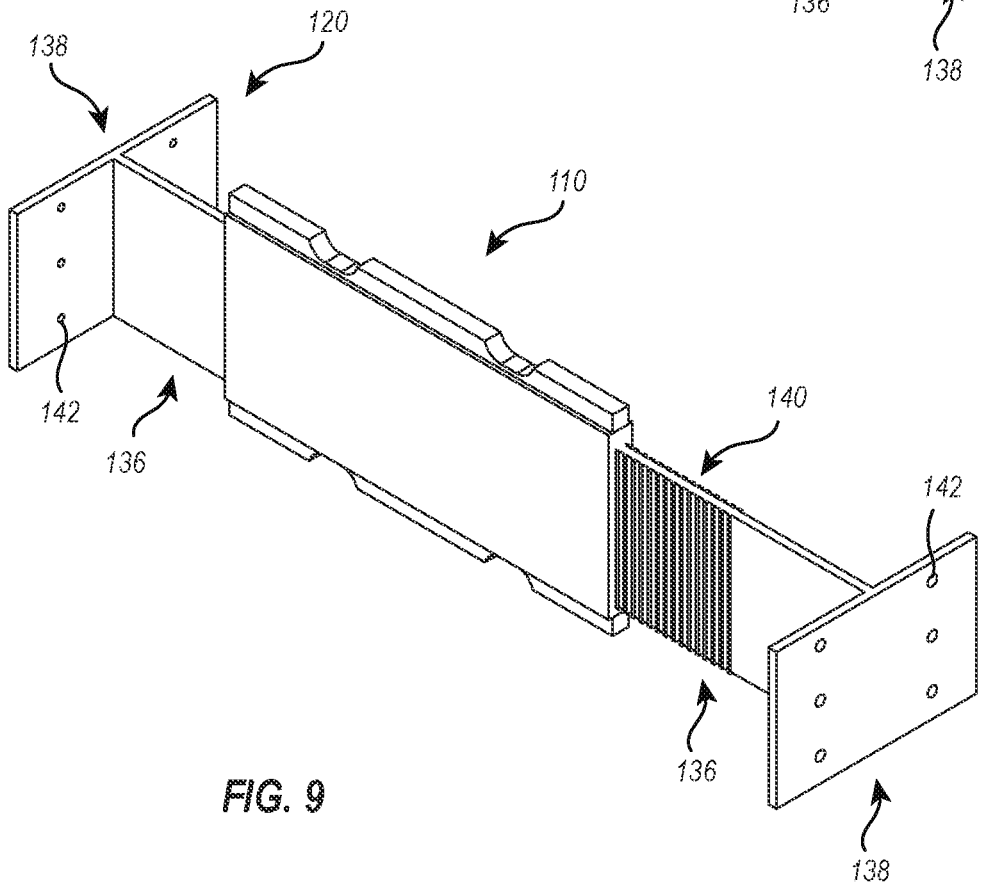
FIG. 9 illustrates the tie sleeve of FIGS. 6-8 with tie sleeve connectors of FIG. 8 connected to the tie sleeve.

As can be seen in FIGS. 8 and 9, the second portion 138 may include one or more apertures 142 extending therethrough. The one or more apertures 142 may be configured to have a fastener extend therethrough to secure the tie sleeve connector 120 to other components (e.g., insulation panels 118, structural components (e.g., 2×2 or 2×4 wood piece(s), metal U- or C-channel studs(s), I-beams, etc.)), as will be discussed below.

Figure 10:
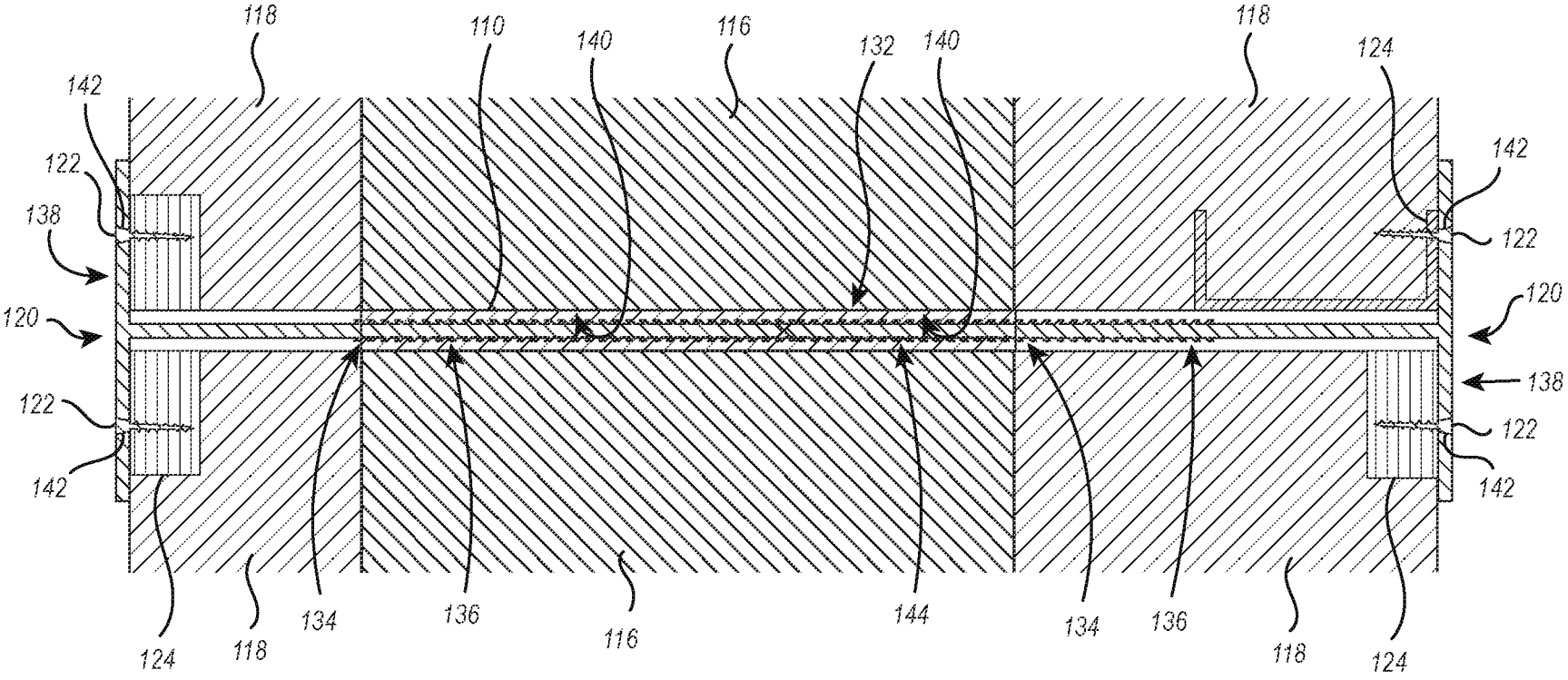
FIG. 10 illustrates a partial cross-sectional view of FIG. 5.

FIG. 10 illustrates a partial cross-sectional view of FIG. 5. As can be seen, the tie sleeve 110 is disposed within concrete wall 116, with the opposing ends thereof being opposed on the opposing surfaces of the concrete wall 116. Insulation panels 118 are positioned against the opposing surfaces of the concrete wall 116. The tie sleeve connectors 120 are used to secure the insulation panels 118, structural components (e.g., 2×2 or 2×4 wood piece(s), metal U- or C-channel studs(s), I-beams, etc. 124) to the concrete wall 116.

In particular, the first portion 136 of each tie sleeve connector 120 extends between adjacent insulation panels 118, and structural components 124, through an opening 134 in tie sleeve 110, and into the channel 132 of the tie sleeve 110. The retention features 140 of the first portions 136 engage with corresponding retention features 144 that are disposed on an interior surface of the channel 132. The retention features 144 may include features that mate with or otherwise engage with the retention features 140. The retention features 144 may include projections, recesses, shoulders, high friction materials/coatings, and the like, or combinations thereof. The engagement between retention features 140, 144 secures the first portions 136 (and thus tie sleeve connectors 120) to the tie sleeve 110.

As can be seen in FIG. 10, the tie sleeve connectors 120 can be inserted into the tie sleeve 110 to varying degrees. For instance, the tie sleeve connector 120 on the left of FIG. 10 is inserted further into the tie sleeve 110 than the tie sleeve connector 120 on the right. Such variability can be useful when the insulation panels 118 are different thicknesses, depths or widths on each side of concrete wall 116. However, the tie sleeve connectors 120 can also be inserted the same distance into the tie sleeve 110.

When the tie sleeve connectors 120 are inserted into the tie sleeve 110, as illustrated in FIG. 10, the second portions 138 engage the insulation panels 118 and/or structural components (e.g., 2×2 or 2×4 wood piece(s), metal U- or C-channel studs(s), I-beams, etc. 124). In particular, the second portions 138 of the tie sleeve connectors 120 contact or otherwise engage the outer surfaces (e.g., the surfaces opposite the concrete wall 116) of the insulation panels 118 and/or structural components (e.g., 2×2 or 2×4 wood piece(s), metal U- or C-channel studs(s), I-beams, etc. 124) and press the insulation panels 118 and structural components 124 towards the concrete wall 116. With the first portions 136 secured within the tie sleeve 110 and the insulation panels 118 and structural components 124 sandwiched between the concrete wall 116 and the second portions 138 of the tie sleeve connectors 120, the insulation panels 118 and structural components 124 are held in place and prevented from falling away from the concrete wall 116.

Optionally, the insulation panels 118 and/or structural components 124 may be further secured in place. For instance, one or more fasteners 122 may be inserted through the apertures 142 in the second portions 138 of the tie sleeve connectors 120 and into the insulation panels 118 or the structural components 124 thereof. The addition of the fasteners 122 may help prevent the insulation panels 118 and structural components 124 from moving side-to-side or up and down.

Figure 11:
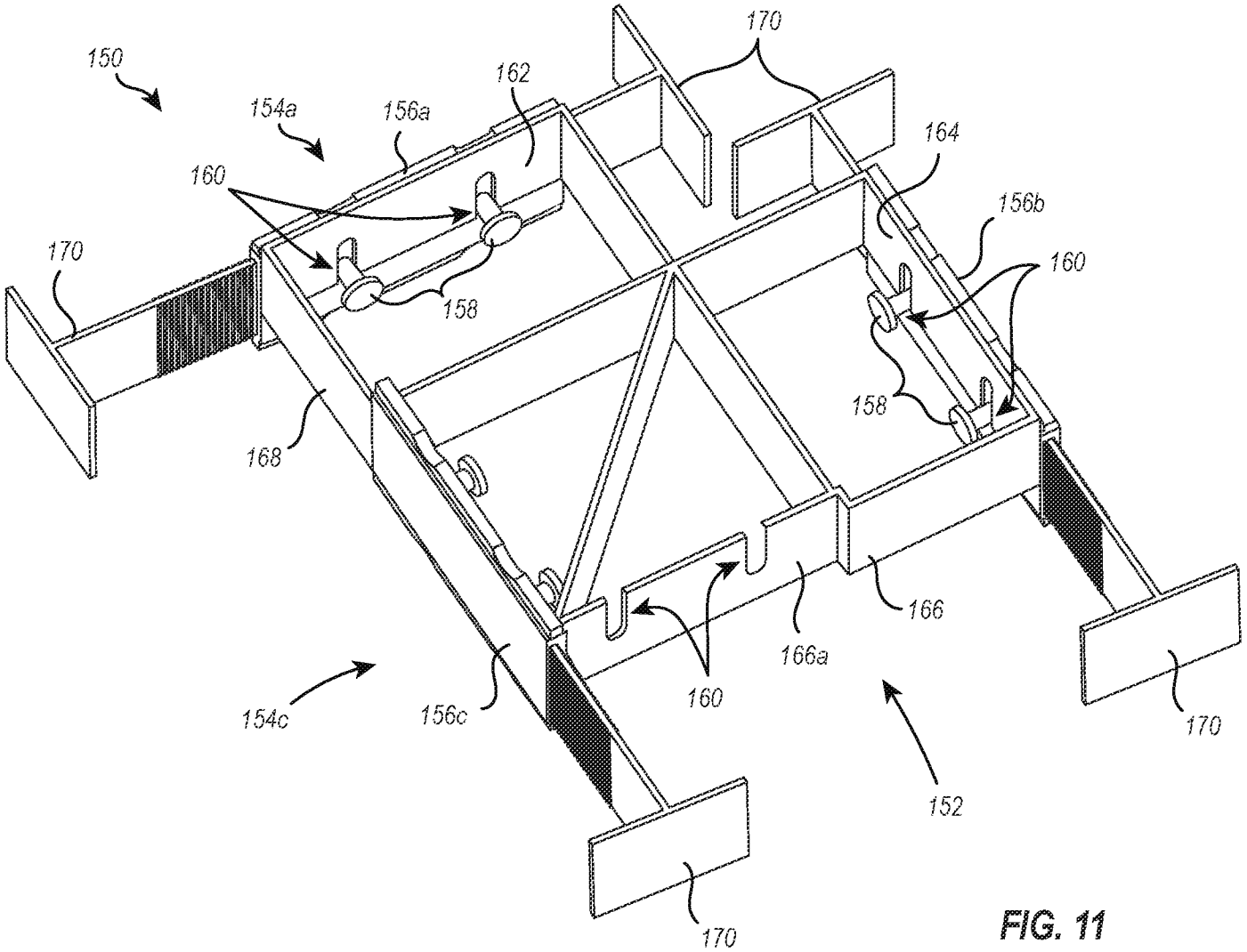
FIG. 11 illustrates an embodiment of a concrete tie system.
Figure 12:
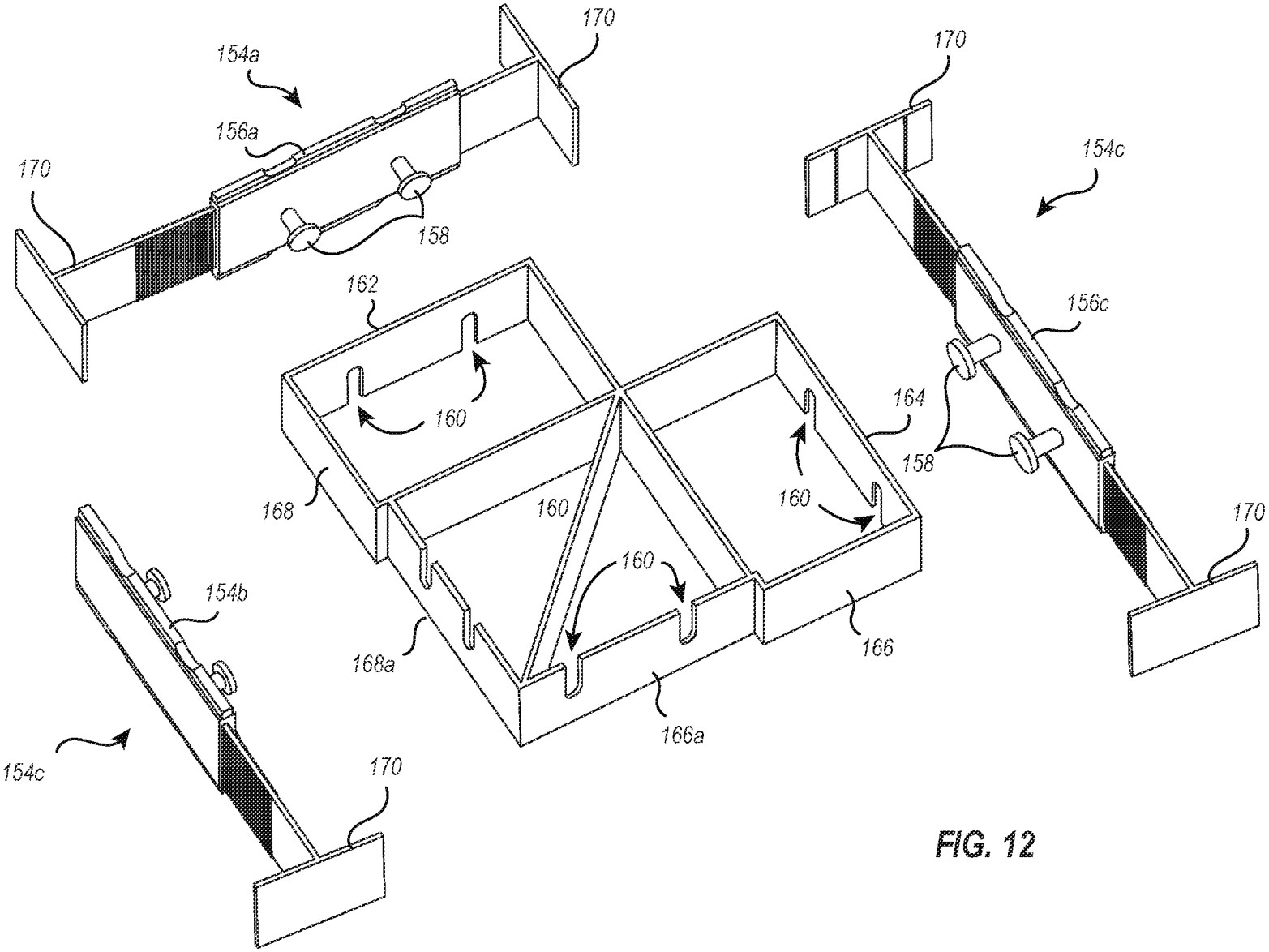
FIG. 12 illustrates an exploded view of the concrete tie system of FIG. 11.

Attention is now directed to FIGS. 11 and 12, which illustrate an example embodiment of a concrete tie system 150. The concrete tie system 150 may be used to secure together concrete form members (similar or identical to form members 104*a*, 104*b*) that form a corner or other non-linear portion of a concrete form system. For instance, two form members (e.g., form members 104*a*) may meet at an angle and two other form members (e.g., form members 104*b*) meet at an angle so as to form opposing sides of a concrete form that is usable to form a concrete wall that has portions that are angled relative to one another.

In the illustrated embodiment, the concrete tie system 150 includes a frame member 152 and a plurality of tie assemblies 154 (154*a*, 154*b*, 154*c*). The tie assembly 154*a* may be used to secure together a first set of opposing form members (e.g., form members 104*a*, 104*b*) and the tie assembly 154*b* may be used to secure together a second set of opposing form members (e.g., form members 104*a*, 104*b*). The tie assemblies 154*a*, 154*b* may be selectively connected to the frame member 152. The connections between the tie assemblies 154*a*, 154*b* and the frame member 152 may secure together the first and second sets of opposing form members at a desired angle relative to one another.

In the illustrate embodiment, the tie assemblies 154*a*, 154*b*, 154*c* include a tie sleeve 156*a*, 156*b*, 156*c*, respectively. In many respects, the tie sleeves 156*a*, 156*b*, 156*c* may be substantially similar or identical to the tie sleeves 110 disclosed herein. Each of the tie sleeves 156*a*, 156*b*, 156*c* may also include one or more connection features 158 selectively or permanently connected thereto or integrally formed therewith. In the illustrated embodiment, each of the tie sleeves 156*a*, 156*b*, 156*c* includes two connection features. The connection features extend from an outer surface of the tie sleeve 156*a*, 156*b*, 156*c*.

The frame member 152 includes corresponding or mating connection features 160. For instance, the frame member 152 includes two connection features 160 formed in a first wall or surface 162 thereof that are configured to receive the connection features of the tie sleeve 156*a*. Similarly, the frame member 152 includes two connection features 160 formed in a second wall or surface 164 thereof that are configured to receive the connection features of the tie sleeve 156*b*. The first and second walls 162, 164 (and the connected tie sleeves 156*a*, 156*b*) may be oriented relative to one another at an angle that is substantially equal the angle formed by the first and second sets of opposing form members.

In the illustrated embodiment, each of the connection features 158 takes the form of a post with a head or shoulder formed at the end thereof opposite to the tie sleeve 156. Each of the connection features 160 takes the form of a slot formed in a wall of the frame member 152. The post portion of the connection feature 158 may slide into the slot of the connection feature 160 through an open side thereof. The head or shoulder of the connection feature 158 may be disposed on a side of the wall of the frame member 152 opposite to the tie sleeve 156. The head or shoulder of the connection feature 158 may engage the connection feature 160 to secure the tie sleeve 156 and the frame member 152 together.

As can be seen, some of the connection features 160 are formed in or open to a lower side of the frame member 152. In use, the tie sleeves 156*a*, 156*b* will be connected between the form members (in a manner similar to that discussed above in connection with FIG. 1, with the tie sleeve connectors 170 illustrated in FIGS. 11 and 12 replaced with ties similar or identical to ties 108). With the ties sleeves 156*a*, 156*b* secured in place, the frame member 152 can be lowered onto the connection features 158 of the tie sleeves 156*a*, 156*b*.

The frame member 152 may also include one or more walls that extend between the first and second walls 162, 164. In the illustrated embodiment, for instance, the frame member 152 includes a third wall 166 and a fourth wall 168. In the illustrated embodiment, a portion 166*a* of the third wall 166 and a portion 168*a* of the fourth wall are inwardly offset from the rest of the third wall 166 and the fourth wall 168, respectively. The offset portions 166*a*, 168*a* may be inwardly offset by a distance that is approximately equal to the width of the tie sleeve 156*c*.

The offset portions 166*a*, 168*a* may include connection features 160 that are similar to those in the first and second walls 162, 164. However, rather than opening downwardly, the connection features 160 in the offset portions 166*a*, 168*a* opening upwardly. Once the frame member 152 has been placed on the connection features 158 of the tie sleeves 156*a*, 156*b*, the tie sleeve 156*c* (without the illustrated tie sleeve connector 170 or a tie) may be connected to one of the offset portions 166*a*, 168*a*. For instance, as illustrated in FIG. 11, the tie sleeve 156*c* may be connected to the offset portion 168*a* by sliding the connection features 158 thereof into the connection features 160 of the offset portion 168*a*. It will be appreciated that, depending on the application, the tie sleeve 156*c* may be connected to either of the offset portions 166*a*, 168*a*.

Although not illustrated, the tie sleeve 156*c* may have one or more plugs or covers to cover one or more of the openings in the ends thereof (e.g., the opening into which the illustrated tie sleeve connector 170 extends).

With the tie sleeves 156*a*, 156*b* connected to the associated form members, the frame member 152 connected to the tie sleeves 156*a*, 156*b*, and the tie sleeve 156*c* connected to the frame member 152, concrete can be poured into the form in the conventional manner. Once the concrete has sufficiently cured, the form members can be removed and the ties can be removed from the tie sleeves 156*a*, 156*b*, as described above. Additionally, if a plug or cover is used with the tie sleeve 156*c*, it can also be removed. Thereafter, structural components and/or insulation panels can be secured to the concrete wall with the illustrated tie sleeve connectors 170 in the same manner described above. The tie sleeve connectors 170 that connect to the tie sleeves 156*a*, 156*b* can function as described above. Similarly, the tie sleeve connector 170 associated with the tie sleeve 156*c* can be used to secure structural components and/or insulation panels to the concrete wall. The orientation and position of the tie sleeve 156*c* (within the offset portion 168*a*) can facilitate connection between structural components and/or insulation panels disposed on an outside corner of the concrete wall.

The tie system disclosed herein can facilitate the quick and reliable securement of insulation panels or other components (conduits, ductwork, etc.) to a concrete wall. No specialty tools or skills are required to use the system. Additionally, the system is simple and easy to use.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A tie system, comprising:

a tie sleeve having a channel extending at least partially therethrough and an opening in a first end thereof to provide access to the channel through the opening, the channel being configured to have a concrete form tie selectively disposed at least partially within the channel and extending out of the tie sleeve through the opening; and a tie sleeve connector configured to be selectively connected to the tie sleeve, the tie sleeve connector having a first portion and a second portion, the first portion being configured to be selectively inserted into the channel through the opening and secured within the channel when the tie is removed from the tie sleeve, the second portion extending from the first portion at an angle and being configured to engage a separate component, the second portion comprising one or more apertures configured to receive one or more fasteners at least partially therethrough.

2. The tie system of claim 1, wherein the channel extends between the first end and an opposing second end of the tie sleeve.

3. The tie system of claim 2, further comprising a second opening in the second end of the tie sleeve to provide access to the channel therethrough.

4. The tie system of claim 1, wherein the tie sleeve comprises an outer surface having one or more recesses formed therein, the one or more recesses being configured to have rebar positioned therein.

5. The tie system of claim 1, wherein the first portion of the tie sleeve connector comprises one or more retention features.

6. The tie system of claim 5, wherein an interior surface of the channel comprises one or more retention features, the one or more retention features of the first portion and the one or more retention features of the channel being configured to engage one another to selectively secure the first portion of the tie sleeve connector within the channel.

7. The tie system of claim 6, wherein the one or more retention features comprise one or more projections, recesses, shoulders, high friction materials or coatings, or a combination thereof.

8. The tie system of claim 1, wherein the second portion of the tie sleeve connector extends from the first portion in two directions.

9. The tie system of claim 1, wherein the second portion of the tie sleeve connector extends from the first portion at a right angle.

10. A tie system, comprising:

a concrete tie having a first end and an opposing second end, the concrete tie having a first engagement feature adjacent to the first end and a second engagement feature adjacent to the second end, the concrete tie being configured to be connected to a concrete form via the first and second engagement features;

a tie sleeve having a channel extending therethrough between opposing first and second ends of the tie sleeve, the tie sleeve having a first opening in the first end thereof and a second opening in a second end thereof to provide access to the channel through the first and second openings, the channel and first and second openings being sized and configured to have the concrete tie disposed partially within the channel with the first and second ends of the concrete tie extending out of the first and second openings in the tie sleeve, the tie sleeve being configured to allow for the concrete tie to be selectively removed from the tie sleeve through the first or second opening; and a tie sleeve connector having a generally T-shape formed by a first portion and a second portion, the first portion being configured to be selectively inserted into the channel through the first or second opening and secured within the channel, the second portion extending from the first portion in opposing directions.

11. The tie system of claim 10, wherein the tie sleeve comprises an outer surface having one or more recesses formed therein, the one or more recesses being configured to have rebar positioned therein.

12. The tie system of claim 10, wherein the first portion of the tie sleeve connector comprises one or more retention features.

13. The tie system of claim 12, wherein an interior surface of the channel comprises one or more retention features, the one or more retention features of the first portion and the one or more retention features of the channel being configured to engage one another to selectively secure the first portion of the tie sleeve connector within the channel.

14. The tie system of claim 13, wherein the one or more retention features comprise one or more projections, recesses, shoulders, high friction materials or coatings, or a combination thereof.

15. The tie system of claim 10, wherein the second portion of the tie sleeve connector comprises one or more apertures configured to receive one or more fasteners at least partially therethrough.

16. The tie system of claim 10, wherein the channel and the second portion have generally corresponding cross-sectional shapes.

17. A tie system, comprising:

a tie sleeve having:

a first end having an opening therein;

an opposing second end having an opening therein;

a channel extending through the tie sleeve between the openings in the first and second ends, the channel being configured to have a concrete tie selectively inserted or removed therefrom through at least one of the openings at the first or second end;

one or more retention features formed on an interior surface of the channel; and one or more recesses formed on an exterior surface, the one or more recesses being configured to receive rebar therein; and a concrete tie having:

a first end;

a second end; and a length that is longer than a length of the tie sleeve such that the first and second ends of the concrete tie extend out of the openings at the first and second ends of the tie sleeve when the concrete tie is disposed partially within the channel.

18. The tie system of claim 17, wherein:

the first end of the concrete tie has an aperture therein; and the second end of the concrete tie has an aperture therein.

19. The tie system of claim 17, further comprising one or more tie sleeve connectors, each tie sleeve connector having a generally T-shape formed by a first portion and a second portion, wherein:

the first portion has one or more retention features on an outer surface thereof, the one or more retention features of the first portion being configured to engage the one or more retention features in the channel to secure the first portion in the channel, the first portion being insertable into the channel through one of the openings when the concrete tie is removed from the tie sleeve; and the second portion has one or more apertures extending therethrough and configured to receive one or more fasteners at least partially therethrough.

* * * * *